US005358648A

United States Patent [19]

Chakravarti

[11] Patent Number: 5,358,648

[45] Date of Patent: Oct. 25, 1994

[54] SPIN FINISH COMPOSITION AND METHOD OF USING A SPIN FINISH COMPOSITION

[75] Inventor: Kalidas Chakravarti, Midlothian, Va.

[73] Assignee: Bridgestone/Firestone, Inc., Akron, Ohio

[21] Appl. No.: 150,518

[22] Filed: Nov. 10, 1993

[51] Int. Cl.[5] ..... D06M 13/224; D06M 13/335

[52] U.S. Cl. ..... 252/8.6; 252/8.75; 252/8.8; 252/8.9; 8/115.6

[58] Field of Search ..... 252/8.6, 8.75, 8.8, 252/8.9; 8/115.6

[56] References Cited

U.S. PATENT DOCUMENTS

| | | | |
|---|---|---|---|
| 3,827,114 | 8/1974 | Crossfield | 28/271 |
| 3,850,819 | 11/1974 | Shay | 252/8.75 |
| 4,064,057 | 12/1977 | Koerner et al. | 252/8.6 |
| 4,069,160 | 1/1978 | Hawkins | 252/8.9 |
| 4,105,567 | 8/1978 | Koerner et al. | 252/8.6 |
| 4,115,621 | 9/1978 | Hawkins | 428/395 |
| 4,153,660 | 5/1979 | Reese | 264/103 |
| 4,252,528 | 2/1981 | Decker et al. | 8/115.6 |
| 4,343,616 | 8/1982 | Decker et al. | 8/115.6 |
| 4,442,249 | 4/1984 | Lees et al. | 523/455 |
| 4,502,968 | 3/1985 | Node et al. | 252/8.9 |
| 4,578,116 | 3/1986 | Rott et al. | 106/18.12 |
| 4,602,916 | 7/1986 | Wilson | 8/580 |
| 4,722,738 | 2/1988 | Wilson | 8/527 |
| 4,816,336 | 3/1989 | Allou et al. | 428/361 |
| 5,116,682 | 5/1992 | Chakravarti | 428/395 |
| 5,232,742 | 8/1993 | Charavarti | 252/8.9 |

*Primary Examiner*—Mark L. Bell
*Attorney, Agent, or Firm*—Daniel N. Hall

[57] ABSTRACT

Spin finish composition for conventional speed spinning of polyester yarns providing yarn of superior quality, low emissions and no significant deposits on processing equipment, is a non-aqueous composition consisting essentially of from 10 to 70% by weight of a trimethylol or tetramethylol $C_1$–$C_3$ alkane ester wherein all the methylol groups are esterified with $C_8$–$C_{10}$ saturated carboxylic acid, preferably trimethylol propane tripelargonate, from 10 to 70% by weight of tetraethylene glycol diester of $C_8$–$C_{10}$ saturated carboxylic acid, preferably tetraethylene glycol diester of decanoic and octanoic acid, from 5 to 50% by weight of low volatility, light viscosity, 15 low surface tension, substantially aromatic-free light mineral oil, preferably consisting essentially of $C_{12}$–$C_{15}$ isoparaffic hydrocarbon, and from 2 to 20% by weight of 1H-imidazolium, 1-ethyl-4,5-dihydro-3-(2-hydroxyethyl)-2-(8-heptadecenyl)-, ethyl sulfate. Compositions with viscosities of greater than 17 as determined with a Brookfield viscometer at 20° C. are heated 40 to 90° C. but below the flash point of any component to reduce the viscosity to provide a reduced viscosity composition for application to polyester yarns.

9 Claims, No Drawings

SPIN FINISH COMPOSITION AND METHOD OF USING A SPIN FINISH COMPOSITION

TECHNICAL FIELD

This invention is directed at a spin finish composition particularly useful for conventional speed spinning of polyester yarns and at a method of using the spin finish composition.

BACKGROUND OF THE INVENTION

The yarns of pertinence here are highly oriented fully drawn polyester (e.g., polyethylene terephthalate) yarns, e.g., high tenacity industrial polyester yarns of 500 to 2,000 denier. These yarns find application as reinforcing in tires, hoses, belts including conveyor belts and in other articles, e.g., industrial rope, grass catcher bags, geotextiles, tarpaulins, and many other industrial products.

Conventional speed spinning of these yarns involves take-up speeds of 3,000 meters or less. The major portion of melt spun polyester yarns is still made utilizing conventional speed spinning processes.

Spin finish compositions for polyester yarns can be either aqueous emulsions or non-aqueous compositions. Aqueous emulsions can provide good performance for high speed spinning processes and for some conventional speed spinning processes, where multiple stages of yarn drawing are used. However, for single stage drawing processes, aqueous spin finishes usually provide inferior results compared to the non-aqueous spin finishes. Some non-aqueous spin finish compositions consist of mixtures of all oily materials, or the oily mixtures can be dissolved in a solvent system, typically kerosene.

SUMMARY OF THE INVENTION

It is an object of this invention to provide an alternative non-aqueous spin finish composition which provides superior polyester yarn quality, which is odor free, which provides significantly reduced emissions during the spin-draw yarn production process, and which provides significantly less deposits on processing equipment, such as roll shells and guides.

In a broad embodiment herein, this object is satisfied by a composition consisting essentially by weight of (a) from 10 to 70%, preferably from 20 to 50%, of trimethylol or tetramethylol $C_1$–$C_3$ alkane ester wherein all the methylol groups are esterified with $C_8$–$C_{10}$ saturated carboxylic acid; (b) from 10 to 70%, preferably from 20 to 50%, of tetraethylene glycol diester of $C_8$–$C_{10}$ saturated carboxylic acid; (c) from 5 to 50% preferably from 7 to 45%, of light mineral oil consisting essentially of $C_{10}$–$C_{20}$ isoparaffinic hydrocarbon and having a vapor pressure less than about 8 mm Hg at 38° C. as determined by ASTM Test Method D2879, a viscosity of less than 8.0 centipoises at 25° C. as determined by ASTM Test Method D445, and a surface tension of less than 31.0 dynes/cm at 25° C. as determined with a duNuoy ring tensiometer; and (d) from 2 to 20%, preferably from 3 to 12%, of 1H-imidazolium, 1-ethyl-4,5-dihydro-3-(2-hydroxyethyl)-2-(8-heptadecenyl)-,ethyl sulfate.

This broad embodiment embraces two narrow preferred embodiments, one with light mineral oil component present in the higher portion of the specified range which is preferably applied at ambient temperature, and a second with light mineral oil component present in the lower portion of the specified range which is preferably heated to reduce the viscosity, for application.

The first of these narrower embodiments is a non-aqueous spin finish composition consisting essentially by weight of (a) from 20 to 30% of trimethylol or tetramethylol $C_1$–$C_3$ alkane ester wherein all the methylol groups are esterified with $C_8$–$C_{10}$ saturated carboxylic acid, (b) from 30 to 40% of tetraethylene glycol diester of $C_8$–$C_{10}$ saturated carboxylic acid, (c) from 35 to 45% of light mineral oil consisting essentially of $C_{10}$–$C_{20}$ isoparaffinic hydrocarbon and having a vapor pressure less than about 8 mm Hg at 38° C. as determined by ASTM Test Method 2879, a viscosity of less than 8.0 centipoises at 25° C. as determined by ASTM Test Method D445, and a surface tension of less than 31.0 dynes/cm at 25° C. as determined with a duNuoy ring tensiometer, and (d) from 3 to 8% of 1H-imidazolium,1-ethyl-4,5-dihydro-3-(2-hydroxyethyl)-2-(8-heptadecenyl)-,ethyl sulfate.

The second of these narrower embodiments is a non-aqueous spin finish composition consisting essentially by weight of (a) from 35 to 50% of trimethylol or tetramethylol $C_1$–$C_3$ alkane ester wherein all the methylol groups are esterified with $C_8$–$C_{10}$ saturated carboxylic acid, (b) from 30 to 50% of tetraethylene glycol diester of $C_8$–$C_{10}$ saturated carboxylic acid, (c) from 5 to 15% of light mineral oil consisting essentially of $C_{10}$–$C_{20}$ isoparaffinic hydrocarbon and having a vapor pressure less than about 8 mm Hg at 38° C. as determined by ASTM Test Method 2879, a viscosity of less than 8.0 centipoises at 25° C. as determined by ASTM Test Method D445, and a surface tension of less than 31.0 dynes/cm at 25° C. as determined with a duNuoy ring tensiometer, and (d) from 5 to 10% of 1H-imidazolium,1-ethyl-4,5-dihydro-3-(2-hydroxyethyl)-2-(8-heptadecenyl)-, ethyl sulfate.

In the above described embodiments, the ester of (a) is preferably trimethylol propane tripelargonate.

In the above-described embodiments, the diester of (b) is preferably tetraethylene glycol diester of decanoic and octanoic acid.

In the above-described embodiments, the light mineral oil of (c) preferably has a viscosity of up to 3.0 centipoises at 25° C. as determined by ASTM Test method D445 and a surface tension of up to 27.0 dynes/cm at 25° C. as determined with a duNuoy ring tensiometer, and very preferably has a vapor pressure ranging from 2.0 to 4.0 mm Hg at 38° C. as determined by ASTM Test Method D2879, a viscosity ranging from 2.0 to 3.0 centipoises at 25° C. as determined by ASTM Test method D445 and a surface tension ranging from 26.0 to 27.0 dynes/cm at 25° C. as determined with a duNuoy ring tensiometer.

We turn now to the melt spinning method as a whole wherein the above-described spin finish compositions find application, i.e., to the spin-draw process where the above-described spin finish compositions find application. This normally comprises extruding polyester filaments from a spinnerette, quenching the extruded filaments using hot air to foster solidification thereof, converging the filaments into a yarn (e.g., using a guide), drawing the yarn (e.g., at a draw ratio of 5.0 to 6.0 by passing the yarn over a pretensioning roll, and then via feed rolls, and then through drawing rolls), optionally passing the drawn yarn through relaxation rolls and then winding the yarn on a bobbin. The spin finish composition is applied to filaments or yarn after the quenching step and prior to drawing, preferably prior to the guide or other apparatus used to cause the filaments to converge to form a uniform ribbon-like yarn bundle. It has been found herein that when a spin finish composition within the scope of the invention has a viscosity greater than 17 cps at 20° C. as measured with a Brookfield viscometer, it is preferably heated to a temperature in the range of 40° to 90° C. (very preferably to a temperature less than the flash point of any component in the spin finish composition to minimize emissions) to reduce the viscosity to 6 to 15 cps as measured with a Brookfield viscometer, for application to the filaments or yarn. This ensures more uniform application of the composition. This heating to reduce the viscosity of the spin finish composition for application to filaments or yarn is especially relevant for use of spin finish composition described above with light mineral oil component in the lower portion of the specified range (described above as the second of the narrower embodiments).

The term "non-aqueous" is used herein in describing a spin finish composition, to mean no water added as an ingredient, but water present only as an impurity in the ingredients.

The term "consists essentially of" is used herein in its legal sense to exclude amounts of unnamed components which would materially affect the chacteristics of the invention, e.g., to exclude the presence of aromatic hydrocarbon in the composition in an amount more than 1% by weight.

The levels of aromatic hydrocarbons stated herein are those determined by UV absorbance.

The term "emissions" is used herein to mean the portion of the composition which vaporizes during the spin-draw process and the "amount of emissions" is considered to be the difference between the amount of composition applied less that left on the yarn product and that deposited on the processing equipment.

Unless otherwise stated, all parts and percentages are by weight.

DETAILED DESCRIPTION

We turn now in more detail to the spin finish composition herein.

The spin finish compositions herein generally have a viscosity ranging from 5 to 35 centipoises at 20° C. as determined with a Brookfield viscometer. The spin finish compositions of said first narrower embodiment typically have a viscosity ranging from 8 to 14 centipoises at 20° C. as determined with a Brookfield viscometer. The spin finish compositions of said second narrower embodiment typically have a viscosity ranging from 20 to 35 centipoises at 20° C. as determined with a Brookfield viscometer for the broad component of (a) and a viscosity ranging from 20 to 25 centipoises at 20° C. as determined with a Brookfield viscometer when the component of (a) is trimethylol propane tripelargonate.

The spin finish compositions herein preferably have a surface tension less than about 27.0 as determined with a Wilhelmy balance at 25° C. and typically have a surface tension ranging from 26 to 27 as determined with a Wilhelmy balance.

The spin finish compositions of the invention described herein have a contact angle of 5° maximum with polyester film or filament as measured with a Wilhelmy balance and preferably have a contact angle of approximately 0° with polyester film or filament (indication of complete wetting) as determined with a Wilhelmy balance.

The spin finish compositions herein are clear solutions. They contain at most 1%, preferably less than 0.5%, very preferably less than 0.2% by weight aromatic hydrocarbon. They contain less than 1% by weight water. They are substantially odor free.

As indicated above, the ester component of (a) is trimethylol or tetramethylol $C_1$–$C_3$ alkane ester wherein all the methylol groups are esterified with $C_8$–$C_{10}$ saturated carboxylic acid. Suitable esters include, for example, trimethylol propane tripelargonate, pentaerythritol tetrapelargonate and pentaerythritol tetra $C_8/C_{10}$ mixed ester. The preferred ester is trimethylol propane tripelargonate, and this ester is available from Henkel Corporation under the tradename Emery 6701. The ester of (a) mainly acts as a thermally stable lubricant in the composition. If too little of this component is used, higher emissions result. If too much of this component is used, the viscosity of the composition is increased to the point where it cannot be appropriately reduced by heating, causing application problems and product defects.

As indicated above, the diester of (b) is tetraethylene glycol diester of $C_8$–$C_{10}$ saturated carboxylic acid. A preferred diester is tetraethylene glycol diester of decanoic and octanoic acids, very preferably a mixed ester. This diester is available under the trade name Lexolube 2N-237 from Inolex Chemical Company. Lexolube 2N-237 is said to contain 50% ester groups derived from decanoic acid and 50% ester groups derived from octanoic acid. Commercial grades may vary from the 50:50 ratio and contain, for example, from 40:60 to 60:40 decanoic:octanoic derived ester groups. Another suitable diester is tetraethylene glycol dipelargonate which has a higher viscosity than the diester of decanoic and octanoic acids. The diester of (b) functions as a lubricant and as a viscosity reducer and to dissolve the component of (d). Sufficient of this component should be used to dissolve the component of (d).

As indicated above, the component of (c) is a light mineral oil consisting essentially of $C_{10}$–$C_{20}$ isoparaffinic hydrocarbon and having a vapor pressure less than about 8 mm Hg at 38° C. as determined by ASTM Test Method D2879, a viscosity of less than 8.0 centipoises at 25° C. as determined by ASTM Test Method D445, and a surface tension of less than 31.0 dynes/cm at 25° C. as determined with a duNuoy ring tensiometer. These light mineral oils typically have average molecular weights ranging from about 160 to 200 and typically contain less than 0.7 weight percent aromatic hydrocarbon. These light mineral oils typically have a volatility defined by a flash point as determined by ASTM Test Methods D56 and D93, ranging from about 50° to 140° C., an initial boiling point as determined by ASTM Test Method D86 ranging from about 175° to 275° C. a 50% distillation temperature as determined by ASTM Test method D86 ranging from about 180° to 290° C., a dry distillation point as determined by ASTM Test Method D86 ranging from about 185° to 315° C., and a vapor pressure in mm Hg at 38° C. as determined by ASTM Test Method D2879 ranging from about 7 to 0.2. These light mineral oils typically have a specific gravity @ 60°/60° F. as determined by ASTM Test Method D1250 ranging from about 0.755 to 0.820, a viscosity at 25° C. as determined by ASTM Test Method D445 ranging from about 1.25 to 7.75 centipoises, and a surface tension at 25°C. as determined with a DuNuoy ring tensiometer ranging from about 25.5 to 30.8 dynes/cm.

Suitable light mineral oils for (c) are sold under the tradenames Isopar H, Isopar K, Isopar L, Isopar M and Isopar V by Exxon Company. Isopar H consists essentially of $C_{10}$–$C_{13}$ isoparaffinic hydrocarbons, contains 0.002 percent by weight aromatic hydrocarbon, and has an average molecular weight of 160, a specific gravity at 60°/60° F. of 0.759, a flash point of 53° C., an initial boiling point at 179° C, a 50% distillation temperature of 182° C., a dry distillation temperature of 187° C., a vapor pressure of 6.2 mm Hg at 38° C., a viscosity of 1.29 centipoises at 25° C. and a surface tension of 24.9 dynes/cm at 25° C. Isopar K consists essentially of $C_{11}$–$C_{13}$ isoparaffinic hydrocarbons, contains 0.01 weight percent aromatic hydrocarbon, and has an average molecular weight of 164, a specific gravity at 60°/60° F. at 0.761, a flash point of 54° C., an initial boiling point of 177° C., a 50% distillation temperature of 185° C., a dry distillation temperature of 197° C., a vapor pressure at 38° C. of 5.7 mmHg, a viscosity of 1.39 centipoises at 25° C. and a surface tension of 25.9 dynes/cm of 25° C. Isopar L consists essentially of $C_{11}$–$C_{14}$ isoparaffinic hydrocarbons, contains 0.01 weight percent aromatic hydrocarbon, and has an average molecular weight of 171, a specific gravity at 60°/60° F. of 0.767, a flash point of 62° C. an initial boiling point of 191° C. a 50% distillation temperature of 195° C., a dry distillation temperature of 205° C., a vapor pressure at 38° C. of 5.2 mm Hg, a viscosity of 1.61 centipoises at 25° C. and a surface tension at 25° C. of 25.9 dynes/cm. Isopar M consists essentially of $C_{12}$–$C_{15}$ isoparaffinic hydrocarbons, contains 0.1 weight percent aromatic hydrocarbon, and has an average molecular weight of 191, a specific gravity at 60°/60° F. of 0.789, a flash point of 89° C. an initial boiling point of 223° C., a 50% distillation temperature of 238° C., a dry distillation temperature of 251° C., a vapor pressure at 38° C. of 3.1 mm Hg., a viscosity of 2.70 centipoises at 25° C. and a surface tension at 25° C. of 26.6 dynes/cm. Isopar V consists essentially of $C_{14}$–$C_{18}$ isoparaffinic hydrocarbons, contains 0.5 weight percent aromatic hydrocarbon, and has an average molecular weight of 197, a specific gravity at 60°/60° F. of 0.818, a flash point of 136° C., an initial boiling point of 273° C., a 50% distillation temperature of 288° C., a dry distillation temperature of 311° C., a vapor pressure at 38° C. of 0.3 mm Hg, a viscosity at 25° C. of 7.50 centipoises and a surface tension at 25° C. of 30.8 dynes/cm. For the Isopars, the flash points are determined by ASTM Test Method D56 (Isopar H, Isopar K, Isopar L) and ASTM Test Method D93 (Isopar M and Isopar V), the initial boiling points, 50% distillation temperatures and dry distillation temperatures are determined by ASTM Test method D86, the vapor pressures are determined by ASTM Test Method D2879, the specific gravities are determined by ASTM Test Method D1250, the viscosities are determined by ASTM Test Method D445 and the surface tensions are determined with a duNuoy ring tensiometer.

The light mineral oil component functions as a lubricant, as a surface tension reducer and also as a viscosity reducer. Use of too little of this component results in high surface tension and high viscosity resulting in decreased wettability. Use of too much of this component results in increased emissions.

A preferred light mineral oil for (c) has a viscosity of up to 3.0 centipoises at 25° C. as determined by ASTM Test Method D445 and a surface tension of up to 27.0 dynes/cm at 25° C. as determined with a duNuoy ring tensiometer. Thus, preferred light mineral oils include Isopar H, Isopar K, Isopar L, and Isopar M but do not include Isopar V which provides less wettability resulting in the need for a higher level of finish application for total coverage.

A very preferred light mineral oil for (c) has a vapor pressure ranging from 2.0 to 4.0 mm Hg at 38° C. as determined by ASTM Test Method D2879. Of the aforementioned Isopars, this embraces only Isopar M. These preferred limitations provide a balance between good wettability and minimizing emissions.

As indicated above, the component of (d) is 1H-imidazolium,l-ethyl-4,5-dihydro-3-(2-hydroxyethyl)-2-(8-heptadecenyl)-,ethyl sulfate. This is also referred to as 1-ethyl-2-(heptadecenyl)-1,2-hydroxyethyl-2-imidazolium ethyl sulfate and as oleyl imidazolene ethyl sulfate. This is available under the tradename Dacospin 092 from Henkel Corporation. This component functions as an antistatic agent. If too little of this component is present, there is significant static generation in the yarn guide resulting in filament ballooning effects in the yarn bundle and causing yarn cohesion problems during processing and hence filament breakage. If too much of this component is present, the viscosity of the composition increases to an undesirable level.

The spin finish composition herein can be prepared by adding the components one-by-one in any order, together with high shear mixing, for example, for 15 minutes to 2 hours. Preferably, the component of (d), i.e., the antistatic agent, is first added to the component of (b), i.e., the diester, to dissolve the antistatic agent therein, and then the other two components are added in any order. This order of addition is beneficial because neither of the other two components, i.e., neither of the components of (a) and (c), will completely dissolve the antistatic agent; so this preferred order of addition reduces the mixing time required. In a preferred preparation process, the antistatic agent is added to the diester with high shear mixing for 10 minutes and then each of the other components is added with 15 to 20 minutes of high shear mixing in each case. The mixing tank in which the preparation is carried out should be free of water and dust.

As previously indicated, when the spin finish composition herein has a viscosity greater than 17 cps at 20° C. as measured with a Brookfield viscometer, it is preferably heated to a temperature in the range of 40° to 90° F. (very preferably to a temperature less than the flash point of any component in the spin finish composition) to reduce the viscosity to 6 to 15 cps as measured with a Brookfield viscometer, for application to the filament, or yarn. This is especially applicable to the spin finish composition of the second narrower embodiment (low amount of light mineral oil component) which typically has a viscosity ranging from 20 to 35 centipoises at 20° C. as measured with a Brookfield viscometer. Preferably, the heating is to a temperature ranging from 50° to 80° C. As indicated, the heating is very preferably to a temperature less than the flash temperature of any component in the spin finish composition. Since the light mineral oil component has the lowest flash point among the ingredients, its flash point governs for this purpose. For example, in a composition containing 10% Isopar M as the light mineral oil component and having a viscosity of 23–24 cps at 20° C. as determined with a Brookfield viscometer, heating to 54° C. reduces the viscosity to 14–15 cps and heating to 75° C. reduces the viscosity to 10 cps. The heating also reduces the surface tension of the composition. The resulting viscosity reduction causes more uniform application to the filaments or yarns. The resulting viscosity and surface tension reductions cause the composition to be characterized by better wettability of the polyester filaments and yarns and ease of application on yarn.

The spin finish compositions herein are readily applied at any point downstream of quenching and upstream of drawing, preferably downstream of quenching and upstream of the converging elements(s), i.e., guide(s). It is preferred that the spin finish composition herein be applied just after the melt spun filaments have reached their solidification state. However, this isn't critical with the spin finish compositions herein on use in the conventional spin-draw processes of polyester production.

The compositions herein are utilized as is (i.e., without dilution) at a level of 0.5 to 1% on the yarn surface, preferably at a level of 0.65 to 0.80%, by weight of the yarn.

Application is carried out in one or a plurality of passes as required for correct level of finish on yarn.

The compositions herein are readily applied with a kiss roll or dual kiss roll or with metering apparatus (slot applicator) or with any combinations of these apparatus. For the embodiment where the spin finish composition is heated for application, heating and application are readily carried out by passing the spin finish composition in indirect heat exchange relation with hot water in a heat exchanger, e.g., in an aluminum or stainless steel heat exchanger, so that the finish composition is heated properly before application, and then passing the heated spin finish composition through a metering slot in the heat exchanger, which meters the composition onto the filaments or yarn.

The compositions herein provide adequate yarn to metal friction needed for proper drawing and subsequent yarn processing, adequate yarn to yarn friction, low static generation and production of yarn of superior quality (virtually no broken filaments or yarn breakage, good yarn cohesion properties for superior fabric applications, uniform fiber properties, excellent adhesion to rubber), no significant deposits on heated draw rolls, significantly lower total emissions, and no visible fumes or unpleasant odors.

The invention is illustrated by the following examples.

Example I

In a 15 gallon vessel are thoroughly admixed 23 lbs. Emery 6701, 34 lbs. Lexolube 2N-237, 38.5 lbs. Isopar M and 4.5 lbs. Dacospin 092. The Dacospin 092 is added to the Lexolube 2N-237, with high shear mixing for 10 minutes to form a solution. Then the Emery 6701 is added and high shear mixing is carried out for 15 minutes. Then the Isopar M is added and high shear mixing is carried out for 15 minutes. The product is a straw colored solution. The resulting spin finish composition has a viscosity at 20° C. of 11 cps as determined with a Brookfield viscometer, a surface tension of 26.2 dynes/cm at 25° C. as determined with a Wilhelmy balance and a contact angle with a polyester film or filament of approximately 0°.

Application with kiss rolls at a finish level on polyethylene terephthalate yarn of 0.65%–0.95% produces very good quality yarn (virtually no broken filaments as observed using a strobe light), no knots, good bundle cohesion, uniform yarn quality, and virtually uninterrupted running of the polyester spin-draw process. At a yarn speed of 200 m/min. in testing for fiber to metal friction using a matte chrome pin, coefficients of friction determined are 0.30 (for finish on yarn at 0.67% level) and 0.29 (for finish on yarn at 0.77% level) compared to a coefficient of friction of 0.34 determined for yarn produced using a kerosene-based non-aqueous formulation at a level of 0.65% finish on yarn. At a yarn speed of 200 m/min. in testing for fiber to metal friction using a polished chrome pin, coefficients of friction determined are 0.67 (for finish on yarn at 0.67% level) and 0.66 (for finish on yarn at 0.77% level) compared to a coefficient of friction of 0.77 determined for yarn produced using a kerosene-based non-aqueous formulation at a level of 0.65% finish on yarn. At a yarn speed of 0.5 cm/minute, in testing for fiber to fiber (stick-slip) properaties, frictional forces (gm) determined are 84.1 (for finish on yarn at 0.67% level), and 67.4 (for finish on yarn at 0.77% level) compared to 77.7 for yarn produced using a kerosene-based non-aqueous formulation at a level of 0.65% finish on yarn, and amplitudes of slip-stick are determined to be 9.0 gm (for finish on yarn at 0.67% level) and 4.0 gm (for finish on yarn at 0.77% level) compared to 5.5 gm for yarn produced using a kerosene-based non-aqueous formulation at a level at 0.65% finish on yarn. This demonstrates improved fiber to metal friction and adequate fiber to fiber friction properties for the composition of this example, as compared to the kerosene-based non-aqueous formulation.

No significant deposits result on the draw roll shells.

The finish roll RPM is adjusted to between 5.0 RPM and 5.7 RPM for the spin finish composition of this example. The finish rolls required adjustment to 10 RPM for equivalent finish level of the kerosene-based formulation on yarn. This indicates a significantly lower level of emissions for the spin finish composition of this example compared to the kerosene-based formulation. Besides, there are no visible fumes or unpleasant odor with the spin finish composition of this example.

When an equal amount of Isopar H, Isopar K or Isopar L is substituted for Isopar M, similar results of good yarn quality are obtained, but slightly higher emissions are obtained due to the higher vapor pressures and lower molecular weights of these Isopars compared to Isopar M.

When an equal amount of Isopar V is substituted for the Isopar M, the wettability is not as good and slightly higher finish on yarn levels are required for good yarn quality, but reduced emissions are obtained even compared to what is obtained when Isopar M is present.

Adhesion to rubber testing is carried out using the following general procedure. The fibers are twisted into 2 or 3 ply cords (usually 12 turns per inch for 1000 denier yarn). The cords so prepared are treated in special treating ovens (called Litzler ovens) using a modified resorcinol-formaldehyde-latex dip system. Three treating zones are utilized after the dip application, and the temperatures of the zones are maintained at 310° F., 475° F. and 475° F., respectively. The treated cords are then embedded in a rubber specimen and curing is carried out at 320° F. for about 20 minutes at about 50 PSI pressure. The cords are then peeled from the rubber specimen with an Instron and examined for surface coverage with rubber as well as for peel strength. Ratings of rubber coverages on cord surfaces are expressed as "A", "B", "C", "D", and "E" meaning 100% 80%

60% 40% and 20% of surface covered with rubber, respectively. Cords treated with the compositions of this example are determined to have an "A" rating, which means the best category of adhesion to rubber. The peel strength per cord is about 1.9 to 2.0 kg, which is considered to be excellent.

Example II

In a 15 gallon vessel are thoroughly admixed 42 lbs. of Emery 6701, 40 lbs. of Lexolube 2N-237, 10 lbs of Isopar M and 8 lbs of Dacospin 092. The Dacospin 092 is added to the Lexolube 2N-237, with high shear mixing for 10 minutes to form a solution. Then the Emery 6701 is added and high shear mixing is carried out for 15 minutes. Then the Isopar M is added and high shear mixing is carried out for 15 minutes. The product is a straw colored solution. The resulting spin finish composition has a viscosity of 23–24 cps at 20° C. as determined with a Brookfield viscometer, a surface tension at 25° C. of 26–27 dynes/cm as determined with a Wilhelmy balance and a contact angle with a polyester film or filament of approximately 0°.

Heating of the composition to 75° C. reduces the viscosity to about 10 cps as determined with a Brookfield viscometer. Heating and application are carried out using a heat exchanger and metering device as described above. Similar results are produced to those with the compositions of Example I except that emissions are even further reduced.

Heating of the composition to 54° C. reduces the viscosity to 14–15 cps as determined with a Brookfield viscometer. Heating and application is carried out using a heat exchanger and metering device as described above. Good yarn quality is produced and emissions are further reduced compared to the results obtained with the compositions of Example I.

In both cases, (i.e., heating the composition to 75° C. and heating the composition to 54° C.), processing produces no visible fumes or unpleasant odors. When the same metering pump speed is used, the composition at 54° C. shows slightly higher finish on yarn compared to the composition at 75° C., under the same testing conditions, mainly due to the viscosity difference.

Example III

In a 15 gallon vessel are thoroughly admixed 35 lbs. of pentaerythritol tetrapelargonate, 49 lbs. of Lexolube 2N-237, 6 lbs of Dacospin 092 and 10 lbs of Isopar M. The Dacospin 092 is added to the Lexolube 2N-237, with high shear mixing for 10 minutes, followed by addition of the pentaerythritol tetrapelargonate and shear mixing for 15 minutes, followed by addition of the Isopar M and shear mixing for 15 minutes. The resulting spin finish composition has a viscosity of about 30 cps at 25° C. as determined with a Brookfield viscometer. The composition is heated to 70° C. and applied via a heat exchanger/metering device as described above. Good yarn processability and quality are obtained. Low emissions are obtained.

Example IV

A composition is made up as in Example III except that pentaerythritol tetra $C_8/C_{10}$ mixed ester is substituted for the pentaerythritol tetrapelargonate. Viscosity of the finish is about 28 cps at 25° C. as determined with a Brookfield viscometer. The finish is heated to about 70° C. and applied via a heat exchanger metering device as described above. Equivalent performance is obtained to that obtained in Example III.

Reference Example 1

An emulsion is prepared containing by weight 10 parts Emery 6701, 10 parts sorbitan monooleate ethoxylated with 5 moles of ethylene oxide per mole of sorbitan monooleate, 5 parts of Dacospin 092 and 75 parts water. The emulsion is made up by adding the oil portion slowly to water with good agitation. The formed emulsion is light bluish grey in color and very stable.

Use of this composition does not provide good quality polyester yarn on use in a conventional spin-draw process in that a large number of broken filaments are present in the yarn and also too many yarn breaks are observed.

Reference Example 2

A spin finish composition is made up containing by weight 36 parts Lexolube 2N-237, 4 parts Dacospin 092, 15 parts of the emulsifier sorbitan monooleate ethoxylated with 5 moles of ethylene oxide per mole of sorbitan monooleate, and 45 parts of Isopar M. This finish composition runs quite well to prepare high tenacity polyester yarn having good yarn physical properties with good adhesion to rubber. However, significant levels of visible emissions are observed, i.e., smoke at draw rolls temperatures near and over 200° C.

Many variations of inventive embodiments will be obvious to those skilled in the art. Thus, the inventive embodiments are defined by the claims.

What is claimed:

1. Non-aqueous spin finish composition for application to polyester yarn, said composition consisting essentially by weight of (a) from 10 to 70% of trimethylol or tetramethylol $C_1$–$C_3$ alkane ester wherein all the methylol groups are esterified with $C_8$–$C_{10}$ saturated carboxylic acid, (b) from 10 to 70% of tetraethylene glycol diester of $C_8$–$C_{10}$ saturated carboxylic acid, (c) from 5 to 50% of light mineral oil consisting essentially of $C_{10}$–$C_{20}$ isoparaffinic hydrocarbon and having a vapor pressure less than about 8 mm Hg at 38° C. as determined by ASTM Test Method D2879, a viscosity of less than 8.0 centipoises at 25° C. as determined by ASTM Test Method D445, and a surface tension of less than 31.0 dynes/cm at 25° C. as determined with a duNuoy ring tensiometer, and (d) from 2 to 20% of 1H-imidazolium, 1-ethyl-4,5-dihydro-3-(2-hydroxyethyl) -2-(8-heptadecenyl)-,ethyl sulfate.

2. The non-aqueous spin finish composition of claim 1 which consists essentially by weight of (a) from 20 to 50% of trimethylol or tetramethylol $C_1$–$C_3$ alkane ester wherein all the methylol groups are esterified with $C_8$–$C_{10}$ saturated carboxylic acid, (b) from 20 to 50% of tetraethylene glycol diester of $C_8$–$C_{10}$ of tetraethylene glycol diester of $C_8$–$C_{10}$ saturated carboxylic acid, (c) from 7 to 45% of light mineral oil consisting essentially of $C_{10}$–$C_{20}$ isoparaffinic hydrocarbon and having a vapor pressure less than about 8 mm Hg at 38° C. as determined by ASTM Test Method D2879, a viscosity of less than 8.0 centipoises at 25° C. as determined by ASTM Test Method D445, and a surface tension of less than 31.0 dynes/cm at 25° C. as determined with a duNuoy ring tensiometer, and (d) from 3 to 12% of 1H-imidazolium, 1-ethyl-4,5-dihydro-3-(2-hydroxyethyl)-2-(8-heptadecenyl)-, ethyl sulfate.

3. The non-aqueous spin finish composition of claim 2 wherein the trimethylol or tetramethylol $C_1$–$C_3$ alkane ester wherein all the methylol groups are esterified with $C_8$–$C_{10}$ saturated carboxylic acid is trimethylol propane tripelargonate.

4. The non-aqueous spin finish composition of claim 2 wherein the tetraethylene glycol diester of $C_8$–$C_{10}$ saturated carboxylic acid is tetraethylene glycol diester of decanoic and octanoic acids.

5. The non-aqueous spin finish composition of claim 2 wherein the light mineral oil has a viscosity of up to 3.0 centipoises at 25° C. as determined by ASTM Test Method D445 and a surface tension of up to 27.0 dynes/cm at 25° C. as determined with a duNuoy ring tensiometer.

6. The non-aqueous spin finish composition of claim 5 wherein the light mineral oil has a vapor pressure ranging from 2.0 to 4.0 mm Hg at 38° C. as determined by ASTM Test Method D2879, a viscosity ranging from 2.0 to 3.0 centipoises at 25° C. as determined by ASTM Test Method D445 and a surface tension ranging from 26.0 to 27.0 dynes/cm at 25° C. as determined with a duNuoy ring tensiometer.

7. The non-aqueous spin finish composition of claim 1 which consists essentially by weight of (a) from 20 to 50% of trimethylol propane tripelargonate, (b) from 20 to 50% of tetraethylene glycol diester of decanoic and octanoic acid, (c) from 7 to 45% of light mineral oil having a vapor pressure ranging from 2.0 to 4.0 mm Hg at 38° C. as determined by ASTM Test Method D2879, a viscosity ranging from 2.0 to 3.0 centipoises at 25° C. as determined by ASTM Test Method D445 and a surface tension ranging from 26.0 to 27.0 dynes/cm at 25° C. as determined with a duNuoy ring tensiometer, and (d) from 3 to 12% of 1H-imidazolium, 1-ethyl-4,5-dihydro-3-(2-hydroxyethyl)-2-(8-heptadecenyl)-, ethyl sulfate.

8. The non-aqueous spin finish composition of claim 7 which consists essentially by weight of (a) from 20 to 30% of trimethylol propane tripelargonate, (b) from 30 to 40% of tetraethylene glycol diester of decanoic and octanoic acid, (c) from 35 to 45% of light mineral oil having a vapor pressure ranging from 2.0 to 4.0 mm Hg at 38° C. as determined by ASTM Test method D2879, a viscosity ranging from 2.0 to 3.0 centipoises at 25° C. as determined by ASTM Test Method D445 and a surface tension ranging from 26.0 to 27.0 dynes/cm at 25° C. as determined with a duNuoy ring tensiometer, and (d) from 3 to 8% of 1H-imidazolium, 1-ethyl-4,5-dihydro-3-(2-hydroxyethyl)-2-(8-heptadecenyl), ethyl sulfate.

9. The non-aqueous spin finish composition of claim 1 which consists essentially by weight of (a) from 35 to 50% of trimethylol propane tripelargonate, (b) from 30 to 50% of tetraethylene glycol diester of decanoic and octanoic acid, (c) from 5 to 15% of light mineral oil having a vapor pressure ranging from 2.0 to 4.0mm Hg at 38° C. as determined by ASTM Test method D2879, a viscosity ranging from 2.0 to 3.0 centipoises at 25° C. as determined by ASTM Test Method D445 and a surface tension ranging from 26.0 to 27.0 dynes/cm at 25° C. as determined with a duNuoy ring tensiometer, and (d) from 5 to 10% of 1H-imidazolium, 1-ethyl-4,5-dihydro-3-(2-hydroxyethyl)-2-(8-heptadecenyl)-, ethyl sulfate.

* * * * *